US007810582B2

(12) United States Patent
Webb

(10) Patent No.: US 7,810,582 B2
(45) Date of Patent: Oct. 12, 2010

(54) COUNTERBALANCE ENABLED POWER GENERATOR FOR HORIZONTAL DIRECTIONAL DRILLING SYSTEMS

(76) Inventor: Charles T. Webb, P.O. Box 714, Aledo, TX (US) 76008-0714

( * ) Notice: Subject to any disclaimer, the term of this patent is extended or adjusted under 35 U.S.C. 154(b) by 32 days.

(21) Appl. No.: 12/272,272

(22) Filed: Nov. 17, 2008

(65) Prior Publication Data

US 2009/0126997 A1 May 21, 2009

Related U.S. Application Data

(60) Provisional application No. 60/988,952, filed on Nov. 19, 2007.

(51) Int. Cl.
*E21B 7/06* (2006.01)

(52) U.S. Cl. ..... 175/55; 175/61; 175/74

(58) Field of Classification Search ..... 175/55, 175/61, 62, 203, 74
See application file for complete search history.

(56) References Cited

U.S. PATENT DOCUMENTS

| | | | | |
|---|---|---|---|---|
| 1,908,503 | A | 5/1933 | Behrend et al. | |
| 3,448,305 | A | 6/1969 | Raynal et al. | |
| 3,832,681 | A | 8/1974 | Kaida et al. | |
| 3,970,877 | A | 7/1976 | Russell et al. | |
| 4,075,603 | A | 2/1978 | Snyder et al. | |
| 4,229,728 | A | 10/1980 | Tremba | |
| 4,539,496 | A | 9/1985 | Thomas et al. | |
| 4,761,577 | A | 8/1988 | Thomas et al. | |
| 4,874,061 | A | 10/1989 | Cole | |
| 5,149,984 | A | 9/1992 | Schultz et al. | |
| 5,155,442 | A | 10/1992 | Mercer | |
| 5,248,896 | A | 9/1993 | Forrest | |
| 5,271,328 | A | 12/1993 | Boulais et al. | |
| 5,285,023 | A * | 2/1994 | Cole et al. | 181/106 |
| 5,305,838 | A | 4/1994 | Pauc | |
| 5,484,029 | A | 1/1996 | Eddison | |
| 5,529,133 | A | 6/1996 | Eddison | |
| 5,577,560 | A | 11/1996 | Coronado et al. | |
| 5,617,926 | A | 4/1997 | Eddison et al. | |
| 5,839,508 | A | 11/1998 | Tubel et al. | |
| 5,957,222 | A | 9/1999 | Webb et al. | |
| 6,216,802 | B1 | 4/2001 | Sawyer | |
| 6,253,847 | B1 | 7/2001 | Stephenson | |
| 6,321,857 | B1 | 11/2001 | Eddison | |
| 6,672,409 | B1 | 1/2004 | Dock et al. | |
| 6,691,802 | B2 | 2/2004 | Schultz et al. | |
| 6,837,314 | B2 | 1/2005 | Krueger et al. | |
| 6,848,503 | B2 | 2/2005 | Schultz et al. | |

(Continued)

*Primary Examiner*—William P Neuder
(74) *Attorney, Agent, or Firm*—Geoffrey A. Mantooth

(57) ABSTRACT

An electrical generating system is used for a horizontal directional drilling system. The drilling system has a generally horizontal drill stem that rotates. A generator has first and second components. The first component rotates with the drill stem, while the second component is able to rotate with respect to the first component. An eccentric mass is rotatably mounted inside of the drill stem and is coupled to the second component, wherein as the drill stem rotates, relative rotational motion is produced between the first and second components and the generator produces electrical power. The eccentric mass is mounted on two spaced apart mounting points inside of the drill stem. The generator provides power to a sonde. The generator is in a housing which has flow channels that allow drilling fluid to flow through the drill stem.

12 Claims, 13 Drawing Sheets

U.S. PATENT DOCUMENTS 6,851,484 B2 2/2005 Klompien
6,857,484 B1 2/2005 Helms et al.
6,864,593 B2 3/2005 Winnacker et al.
7,013,994 B2 3/2006 Eddison
7,025,152 B2 4/2006 Sharp et al.
7,083,008 B2 8/2006 Thorp et al.
7,133,325 B2 11/2006 Kotsonis et al.
7,165,608 B2 1/2007 Schultz et al.
7,234,543 B2 6/2007 Schaaf
7,337,858 B2 3/2008 Hall et al.
7,347,283 B1 3/2008 Sharp et al.
7,400,262 B2 7/2008 Chemali et al.

* cited by examiner

COUNTERBALANCE ENABLED POWER GENERATOR FOR HORIZONTAL DIRECTIONAL DRILLING SYSTEMS

This application claims the benefit of U.S. provisional application Ser. No. 60/988,952, filed Nov. 19, 2007.

FIELD OF THE INVENTION

The present invention relates to electrical generating systems for horizontal directional drilling systems.

BACKGROUND OF THE INVENTION

Horizontal directional drilling (HDD) operations are used in drilling for utilities such as water and telephone lines. In HDD, the boreholes are shallow and typically extend under roads, rivers and other obstacles. To drill the borehole, a drill string is equipped with a drill bit. The drill string is rotated and forced through the ground. Fluid in the form of water or drilling mud is circulated through the drill stem, out the drill bit and back to the surface on the outside of the drill stem.

Drill stems or strings typically contain a sonde. The sonde is located near the drill bit and transmits a signal. One such sonde is shown and described in U.S. Pat. No. 5,155,442. An operator on the surface above the drill bit has a receiver and can receive the signal. Sonde information is used to guide and steer the drill bit and consequently guide and steer the borehole.

The sonde requires electrical power to operate. In the prior art, this power is generated by one of seven ways.

One of the primary ways to supply power downhole is simply through the use of batteries. This system is used in some of the sondes offered by Digital Control Inc. or Charles Machine Works. These batteries have a lifespan that varies, but a typical lifespan is less than 20 hours. The problem with this is that these batteries often fail during the drilling operation. Pulling the drill stem out of the bore and replacing the batteries increases the cost of drilling. Also, batteries need frequent changing requiring operator time to access the sonde. Also once these batteries are "used up" they are thrown away, contributing to a more toxic environment.

A second way to supply power to the electrical components downhole is to thread a conductive wire through the center of the drill stem. This method is known as a wireline system. This wire supplies electrical power from a power source on the surface. In order to use this system the wire has to be extended through each drill stem as the bore is lengthened. This is done by connecting additional lengths of wire in the I. D. of the stem and then encasing the connection in a protective wrap. U.S. Pat. No. 5,577,560 refers to this type system. This system is very time consuming and cannot be done on some drill rigs.

A third power supply system uses impellers rotated by the flow of drilling fluid. U.S. Pat. Nos. 7,165,608 and 7,133,325 show this type generating system. A simple generator is sealed off from the drilling fluid while its rotor is turned by the flow of drilling fluid. This system is relatively expensive to produce and is subject to break downs because of the corrosive nature of the drilling fluids.

A fourth way of generating electrical power is disclosed in U.S. Pat. Nos. 6,857,484 and 5,957,222. These systems have a generator that is lateral to the drill stem and engaged with the drill by gears. As the drill stem rotates, the generator produces power. These systems are relatively expensive.

A fifth way to generate power downhole is to use a dual drill stem system as does Charles Machine Works as described in U.S. Pat. Nos. 6,857,484 and 7,025,152. This system utilizes a drill string inside of a drill string extended to the surface to activate the elements of a typical generator. Again this system is quite expensive.

A sixth way is a linear generator which is included in a shock absorber together with the other subsurface components. Details of the linear generator included in a shock absorber can be found in U.S. Pat. No. 3,448,305. This system is expensive and very unwieldy in a drill string.

A seventh system uses responsive means that uses a piezoelectric disc connected to rectifying and smoothing circuits whereby a D.C. output is obtained. For example, U.S. Pat. No. 3,970,877 discloses a method for generating downhole electric energy using a means responsive to turbulence in the drilling mud flow to convert vibratory motion into an electrical output. This system does not produce an adequate amount of power.

SUMMARY OF THE INVENTION

The present invention provides an electrical generating system for use in a horizontal directional drilling system. The drilling system has a generally horizontal drill stem that rotates. The electrical generating system comprises a generator and an eccentric mass. The generator has first and second components. The first component is coupled to rotate with the drill stem. The second component is capable of relative rotation with respect to the first component. One of the first and second components comprises an armature and the other of the first and second components comprises a field. The eccentric mass is mounted inside of the drill stem so as to rotate therein. As the drill stem rotates, the eccentric mass can remain stationary. The eccentric mass is coupled to the second component, wherein when the drill stem rotates, relative rotational motion is produced between the first and second components and the generator produces electrical power.

In accordance with one aspect of the present invention, a transmission is provided. The transmission has an input and an output. The eccentric mass is coupled to the transmission input and the second component is coupled to the transmission output.

In accordance with another aspect of the present invention, the second component counter-rotates relative to the first component.

In accordance with still another aspect of the present invention, a sonde is electrically coupled to the generator.

In accordance with still another aspect of the present invention, the second component comprises a rotor.

In accordance with still another aspect of the present invention, the eccentric mass further comprises two spaced apart mounting points where the mass is rotatably mounted to the drill stem.

In accordance with still another aspect of the present invention, flow channels are provided for drilling fluid flowing through the drill stem.

In accordance with still another aspect of the present invention, the eccentric mass is held relatively stationary by gravity.

In accordance with still another aspect of the present invention, an electrical regulator is electrically connected to an output of the generator.

In accordance with still another aspect of the present invention, the electrical regulator is connected to a load, the regulator connecting the load to the generator output when the generator produces a voltage that exceeds a predetermined threshold.

DESCRIPTION OF THE PREFERRED EMBODIMENTS

The present invention is used in a drill stem for Horizontal Directional Drilling (HDD). HDD is used to drill horizontal boreholes close to the earth's surface. Such boreholes extend, for example, under roads, buildings, and rivers, and are used to bury utilities, such as telephone and water lines.

The present invention utilizes generator components to generate electrical power downhole for the purpose of providing continuous power to a sonde in a drill stem. With the present invention a rechargeable power source (RPS) is charged and recharged whenever the drill string is rotated. The sonde draws electrical power from the rechargeable power source. Alternatively, the sonde could draw power, directly from the generator components with or without drawing power from the rechargeable power source, or from a combination of the generator components and a non-rechargeable power source.

The generator is driven by the rotation of the drill stem. The generator body or stator is connected to the drill stem, so that when the drill stem is rotated the generator stator is rotated. The rotor of the generator is attached to an eccentric mass. The eccentric mass and rotor are stationary, due to the effects of gravity, as the drill stem rotates. This relative rotation between the rotor and the stator produces electrical power.

The electrical power from the generator is provided to appropriate electrical devices that regulate and modify the current in such a way as to provide a suitable output for charging and recharging a rechargeable power source. These electrical components are generally attached to the generator so that all connections are relatively solid.

The drill stem is generally horizontal as the borehole is drilled. The borehole begins at the surface, extends down on a slope to some depth, extends at or near that depth may change depths to avoid obstacles and extends back to the surface on a slope. In all of the various positions of the borehole, the drill stem is said to be horizontal. The borehole is relatively shallow as its objective is to traverse a horizontal distance. Contrast this with an oil well borehole; its objective is to achieve access to a formation at some depth.

Figure 1:
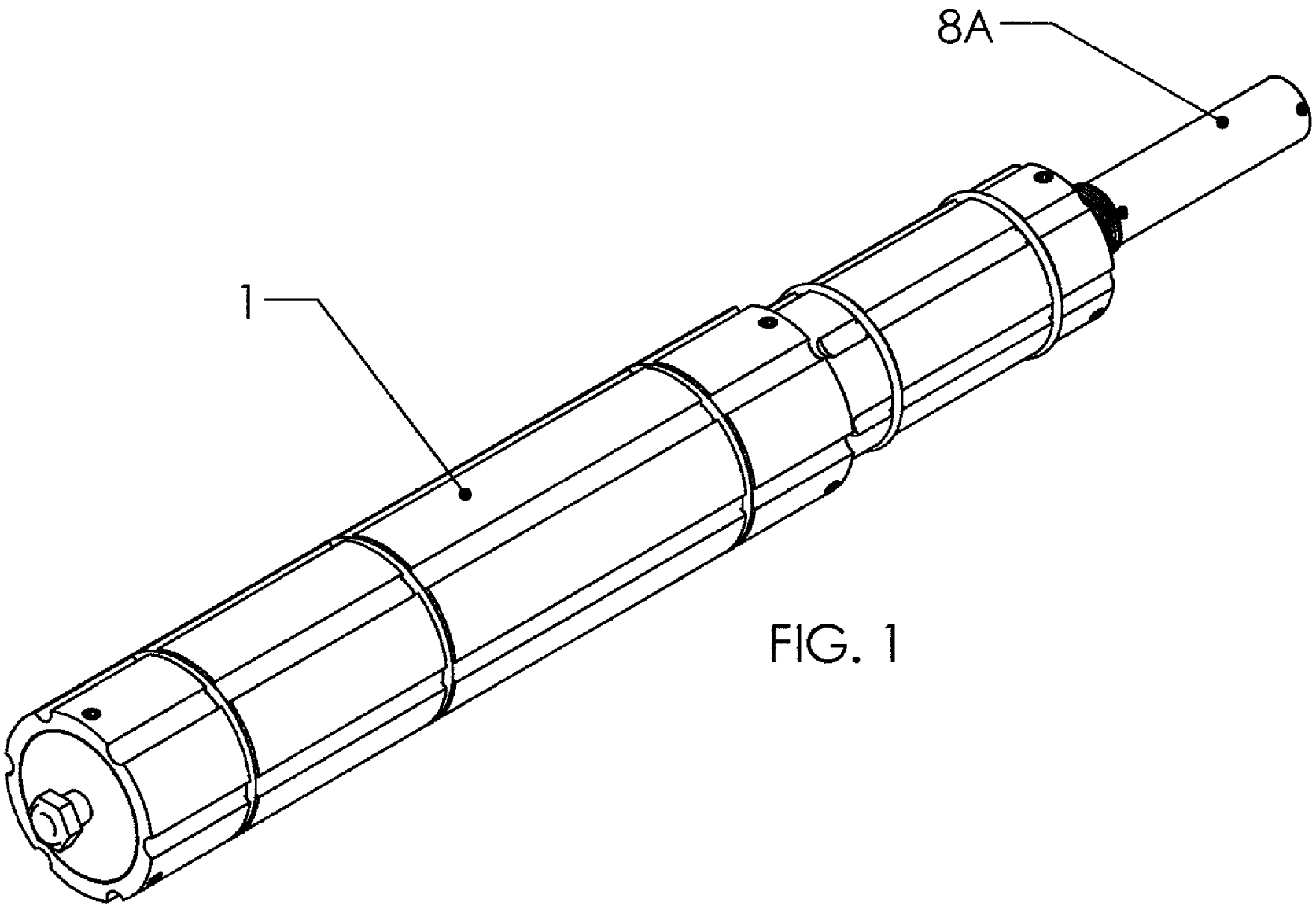
FIG. 1 is an isometric view of the counterbalance enabled power generator.

FIG. 1 shows a preferred embodiment of the counterbalance enabled power generator unit 1 of the present invention. The generator unit 1 couples to a sonde 2. The generator unit 1 and sonde 2 are located within a housing 9 (see FIGS. 13A-13C). The housing 9 is connected in line with a drill stem; the housing 9 forms part of the drill stem. The housing 9 is typically located close to the drill bit. In the preferred embodiment, the housing 9 is connected to the drill bit or a drill bit sub.

Figure 2:
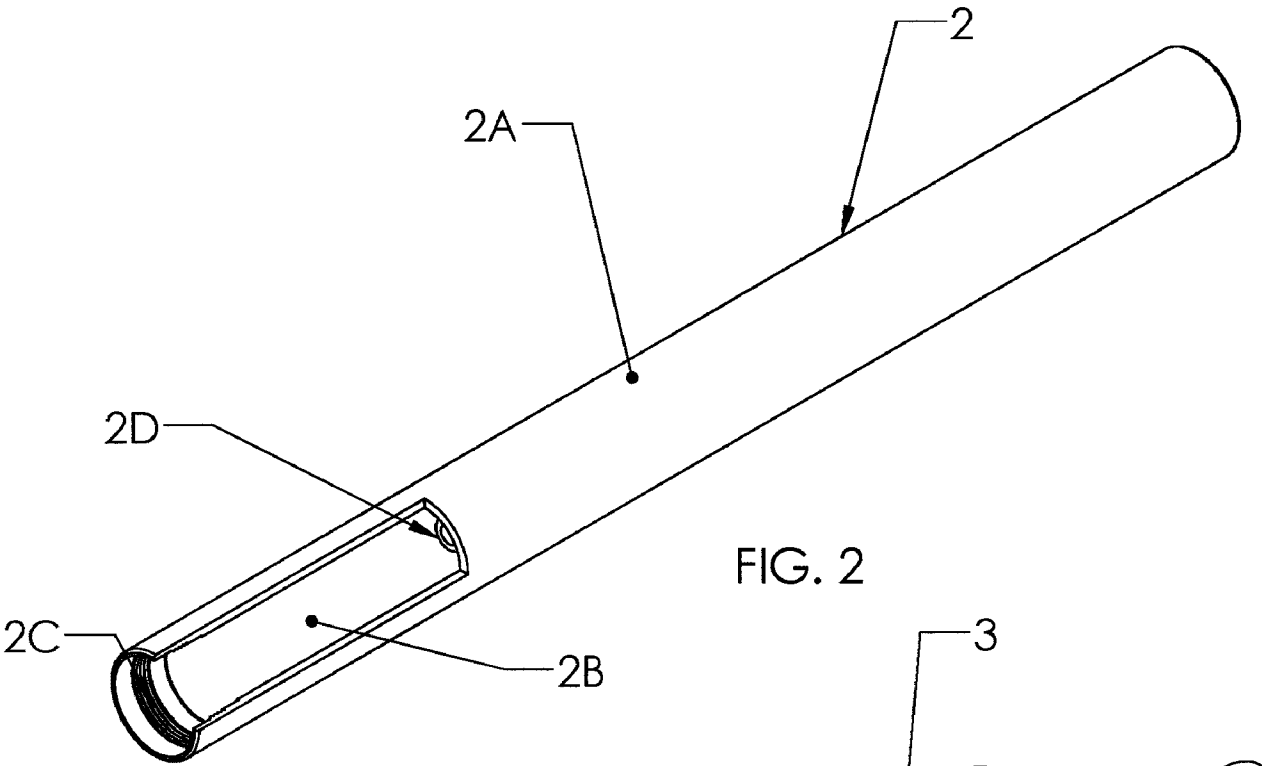
FIG. 2 is an isometric view of the sonde showing a portion cutaway to reveal a battery cavity.

The sonde 2, which is conventional and commercially available, is shown in FIG. 2. The sonde 2 transmits a radio signal that is picked up by a receiver on the surface. The sonde 2 has a body 2A and a cavity 2B at one end for receiving a power supply. In FIG. 2, the sonde is shown partially cut away to show the cavity 2B. The cavity 2B has threads 2C on its outer end. The threads 2C and the body 2A act as a ground for the flow of electricity. The opposite end of the cavity 2B has the positive terminal 2D for the sonde 2. The sonde 2 is turned on once power is provided. Some sondes may have an on-off switch. If so, the sonde is turned on before it is placed in its housing. Once turned on, the sonde operates continuously. Sondes may have an automatic shut-off. For example, if the sonde stops rotating for a predetermined period of time, such as when drilling has stopped, the sonde will automatically turn off. As another example, some sondes have a park position, where if the sonde is oriented at a particular clock position (with respect to the axis of rotation of the drill stem) for a predetermined period of time, it turns off. If the sonde is automatically turned off, it will turn back on once rotation of the drill stem resumes.

Figure 3A:
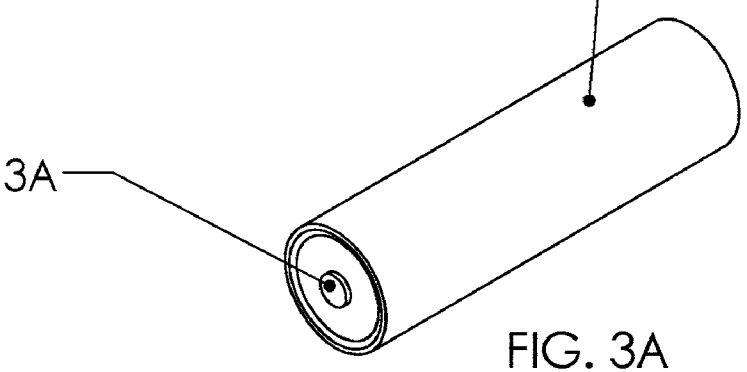
FIG. 3A is an isometric view of the rechargeable power source showing one end.
Figure 3B:
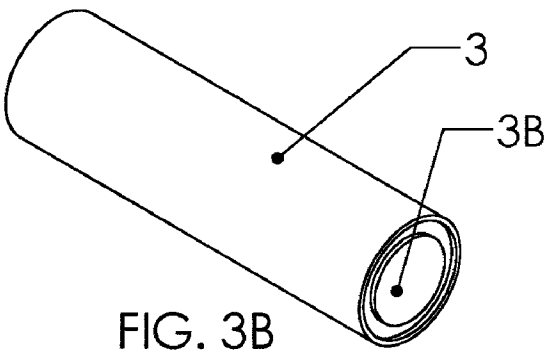
FIG. 3B is an isometric view of the rechargeable power source showing the other end.

FIGS. 3A and 3B show the conventional and commercially available rechargeable power source 3 with a positive terminal 3A and a negative terminal 3B. As discussed below, the power supply 3 is contained within an end of a case, which is in turn located in the cavity 2B.

Figures 11A, 11B:
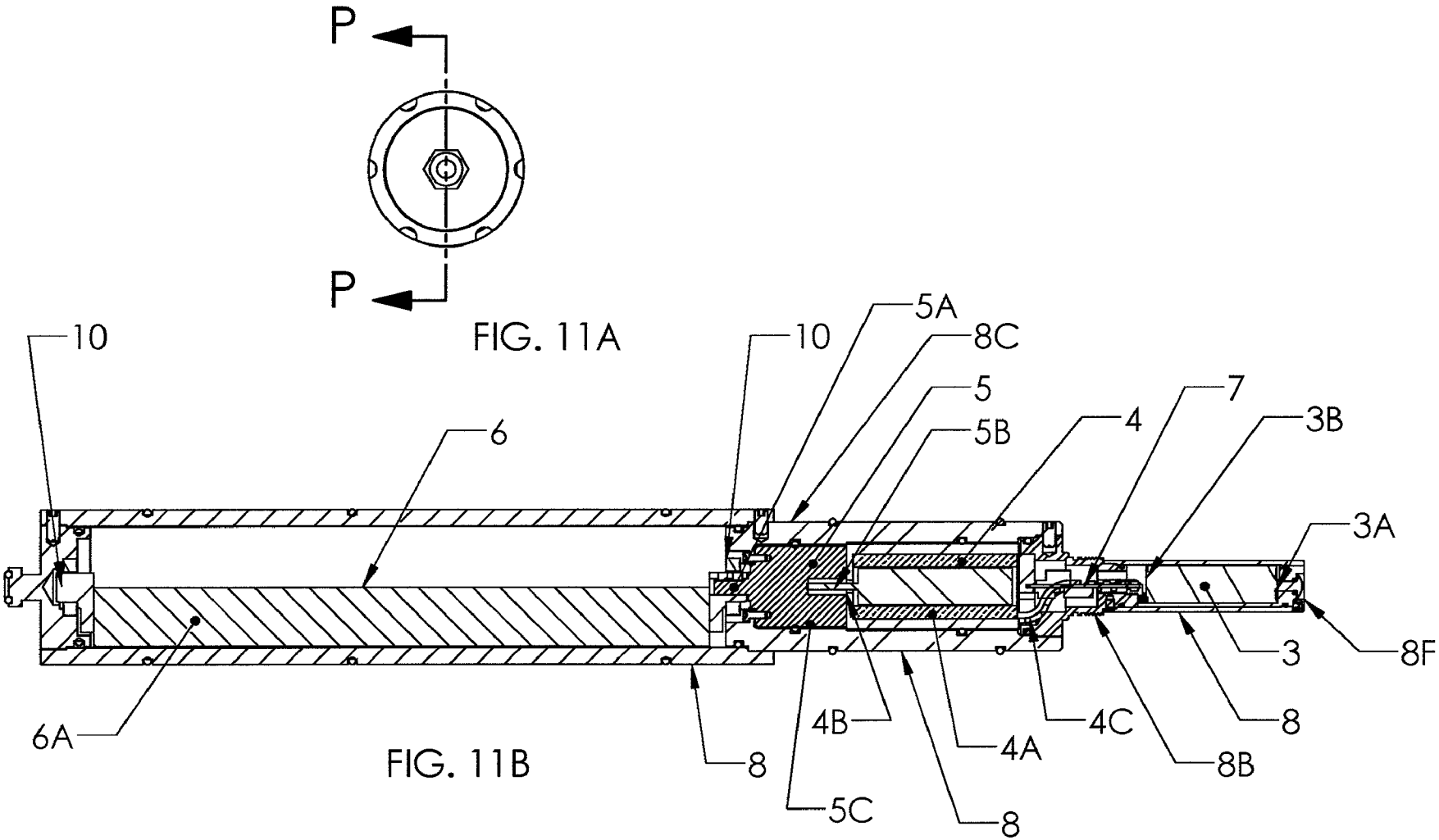
FIG. 11A is an end view of the counterbalance enabled power generator.
FIG. 11B is a cross-sectional view of the counterbalance enabled power generator taken along the lines P-P of FIG. 11A.

The generator unit 1 includes a generator 4, a transmission 5, an eccentric mass 6, electronics 7 and a case 8 (see FIG. 11B).

Figure 4A:
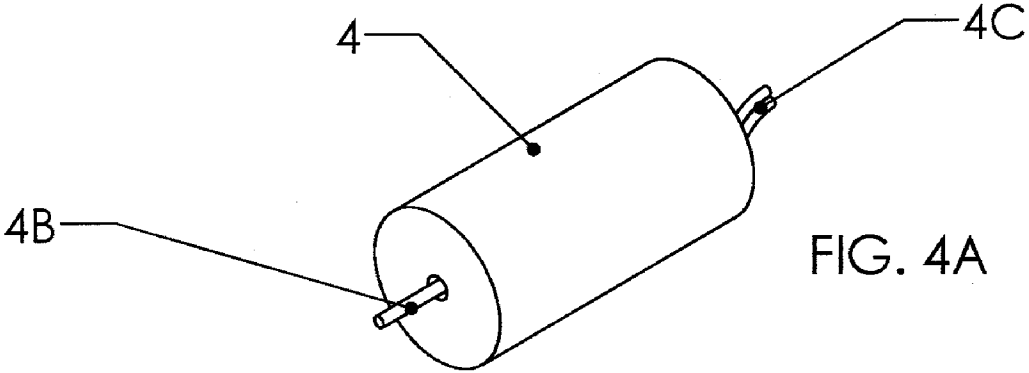
FIG. 4A is an isometric view of the generator.
Figure 4C:
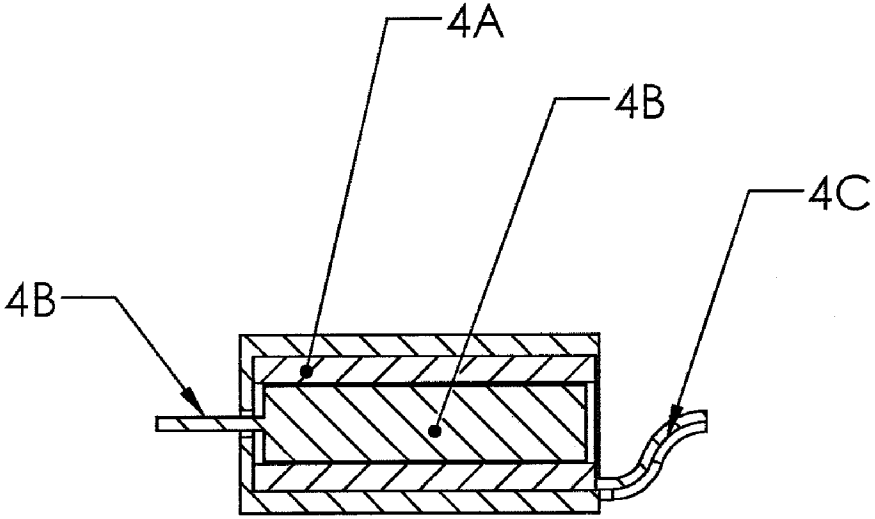
FIG. 4C is a cross sectional view taken along the lines M-M of the generator of FIG. 4B.
Figure 4B:
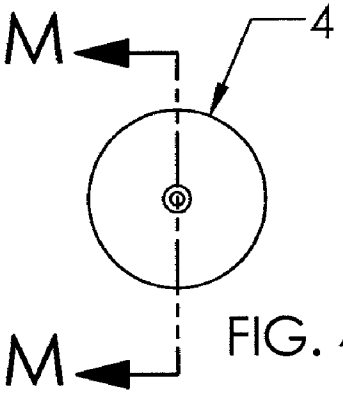
FIG. 4B is an end view of the generator.

FIGS. 4A-4C shows the generator 4 which is conventional and commercially available. I have chosen to use a three phase alternating current generator 4 because of their commercial availability. The generator 4 has a stator 4A and a rotor 4B. At least one of the rotor 4B or the stator 4A has conductive windings that form an armature, while the other of the rotor 4B or the stator 4A has magnets that form a field. The magnets can be permanent magnets or electromagnets, Relative rotation of the stator 4A to the rotor 4B produces electrical power. Electrical leads or conductors 4C extend out of the generator 4. The rotor 4B has a shaft that extends therefrom. In addition, using a generator allows electrical power to be produced when the drill stem is rotated in either direction. While traditionally the drill stem is rotated only in a clockwise direction, there are instances when it is rotated counterclockwise, such as to carve a hole.

Figures 5A, 5B:
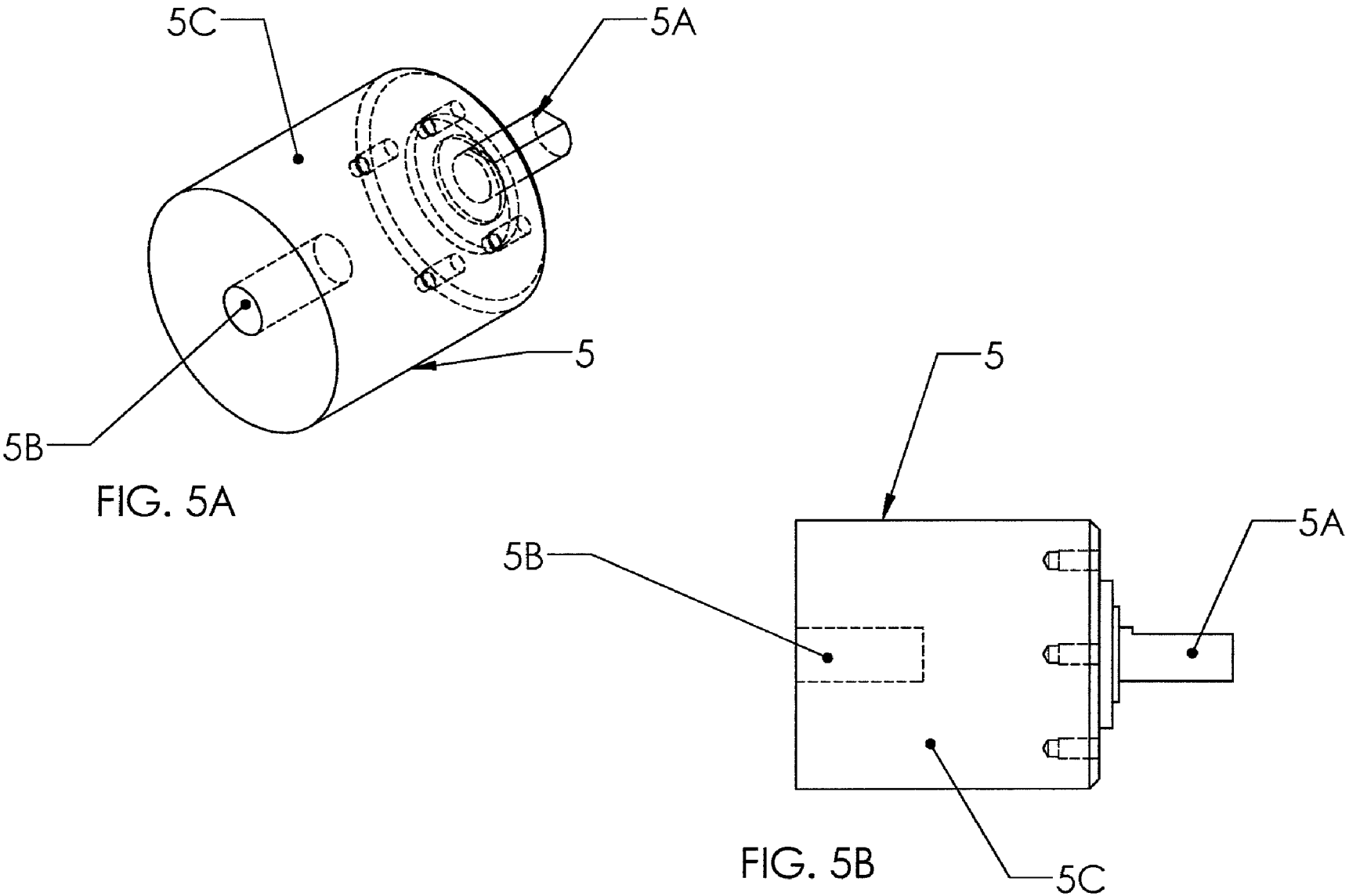
FIG. 5A is an isometric view of the speed convertor showing hidden lines.
FIG. 5B is a side view of the speed convertor showing hidden lines.

FIGS. 5A and 5B show the transmission or speed convertor 5. Said transmission 5 is desirable to be used with the particular generator 4 because of the relative low rotation speed of the drill stem. The transmission 5 is of the planetary gear type and obtains relative high rotational speeds between the rotor 4B and the stator 4A by counter rotating the rotor 4B relative to the stator 4A and the drill stem. For example, if the drill stem rotates clockwise, the rotor 4B rotates counterclockwise. The transmission 5 is conventional and commercially available and has a transmission body 5C, rotational input component 5A and an output component 5B. In this configuration the output component 5B rotates at a higher revolution than the input component 5A. Both the output component 5B and the input component 5A rotate relative to the transmission body 5C. The body 5C is coupled to the drill stem so as to rotate in unison therewith. The ring gear of the transmission 5 is coupled to the body 5C. The transmission 5 can be one or more stages. In the preferred embodiment, a single stage has a speed ratio of about 10:1, while a two stage has a speed ratio of about 15:1.

Figures 6A, 6B, 6C:
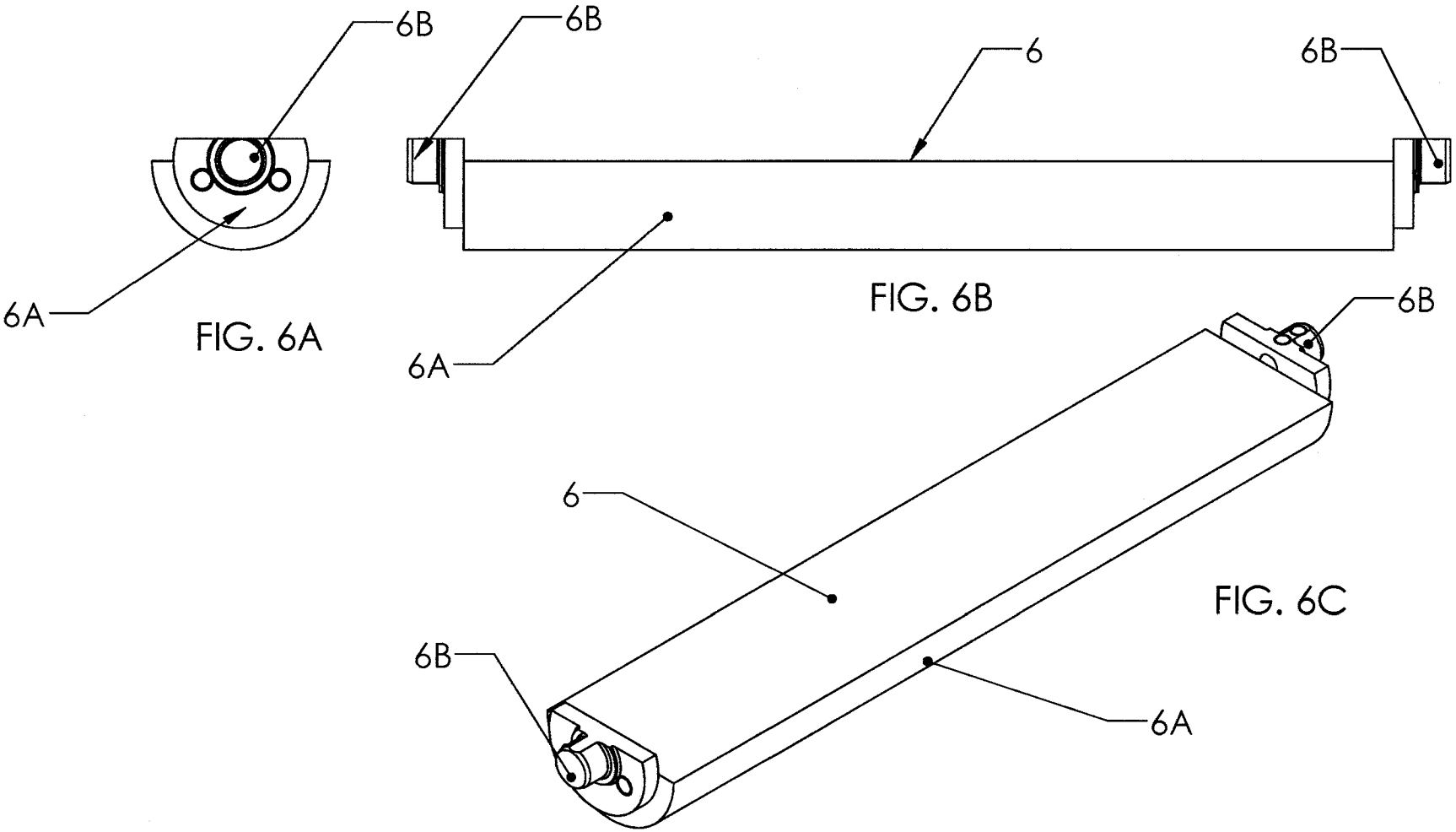
FIG. 6A is an end view of the eccentric mass.
FIG. 6B is a side view of the eccentric mass.
FIG. 6C is an isometric view of the eccentric mass

FIGS. 6A-6C shows the eccentric mass 6. The eccentric mass 6 acts as the counterbalance in the counterbalance enabled power generator 1. The eccentric mass 6 is composed of relatively high specific gravity material, such as lead or tungsten, and has a center of gravity 6A, that when installed into the counterbalance enabled power generator 1, is not on centerline of the input shaft 5A of the transmission 5 (or if no transmission is used, is not on the centerline of the generator rotor 4B). In this embodiment the body of the mass is semicylindrical in cross-section and has supports 6B at each end. The supports 6B are along the axis of rotation of the transmission input shaft 5A, while the body center of gravity 6A is offset from the axis of rotation of the input shaft of the transmission 5 or the generator rotor 4B. In the preferred embodiment, the supports 6B are close to being coaxial with the axis of rotation of the drill stem. As a practical matter, the portion of drill stem containing the eccentric mass may rotate about an axis that is different than the centerline of that drill stem portion. Nevertheless, the eccentric mass can still operate properly. The size or magnitude of the mass can vary depending on several factors. The mass should be at least large enough to hold the transmission input shaft 5A stationary (or rotor 4B stationary or provide reverse rotation). A larger electrical load may require a larger mass, as the load will have a tendency to exert a stronger rotational force on the rotor. A larger speed ratio in the transmission may also require a larger mass as the mechanical load is greater. Also, the amount or distance of offset of the center of gravity of the mass from the axis of rotation of the input of the transmission is a factor. The larger the offset, the less the mass can be. If need be, the housing surrounding the mass can be enlarged in diameter to accommodate a larger offset. In the preferred embodiment, the mass and offset are sized so that the transmission input shaft 5A is stationary (or rotor 4B stationary or providing reverse rotation) under a variety of circumstances. In the preferred embodiment, the product of the size or magnitude of the mass and the distance of its center of gravity from the axis should be at least larger by a factor of 1.5 than the resistant torque on the rotor 4B.

Figure 7:
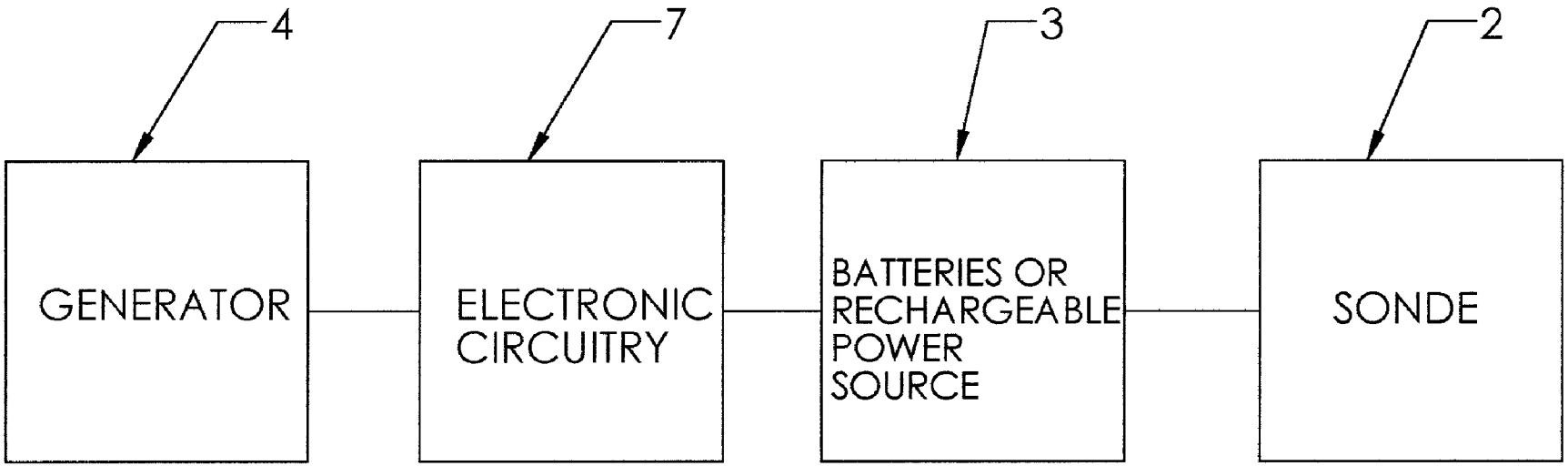
FIG. 7 is a block diagram of the electrical components of the counterbalance enabled power generator.

FIG. 7 is a block diagram of the electrical components 7 of the counterbalance enabled power generator 1. The generator 4 is connected to electronic circuitry 7, which will be described in more detail with reference to FIG. 8. The electronic circuitry 7 rectifies, and regulates the output of the generator 4. The electronic circuitry 7 is connected to the rechargeable power source 3, which in turn is connected to and provides power to the sonde 2.

Figure 8:
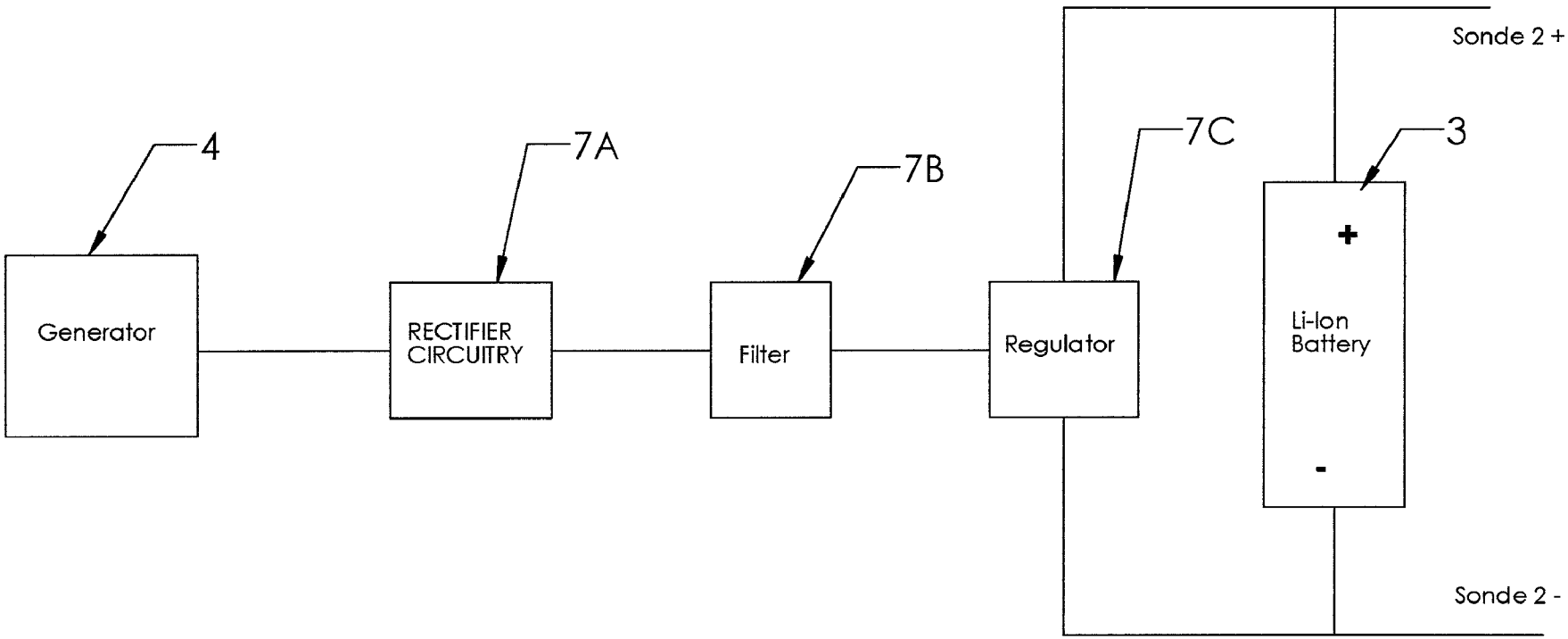
FIG. 8 is a block diagram of the electronic regulating circuitry.
Figure 8A:
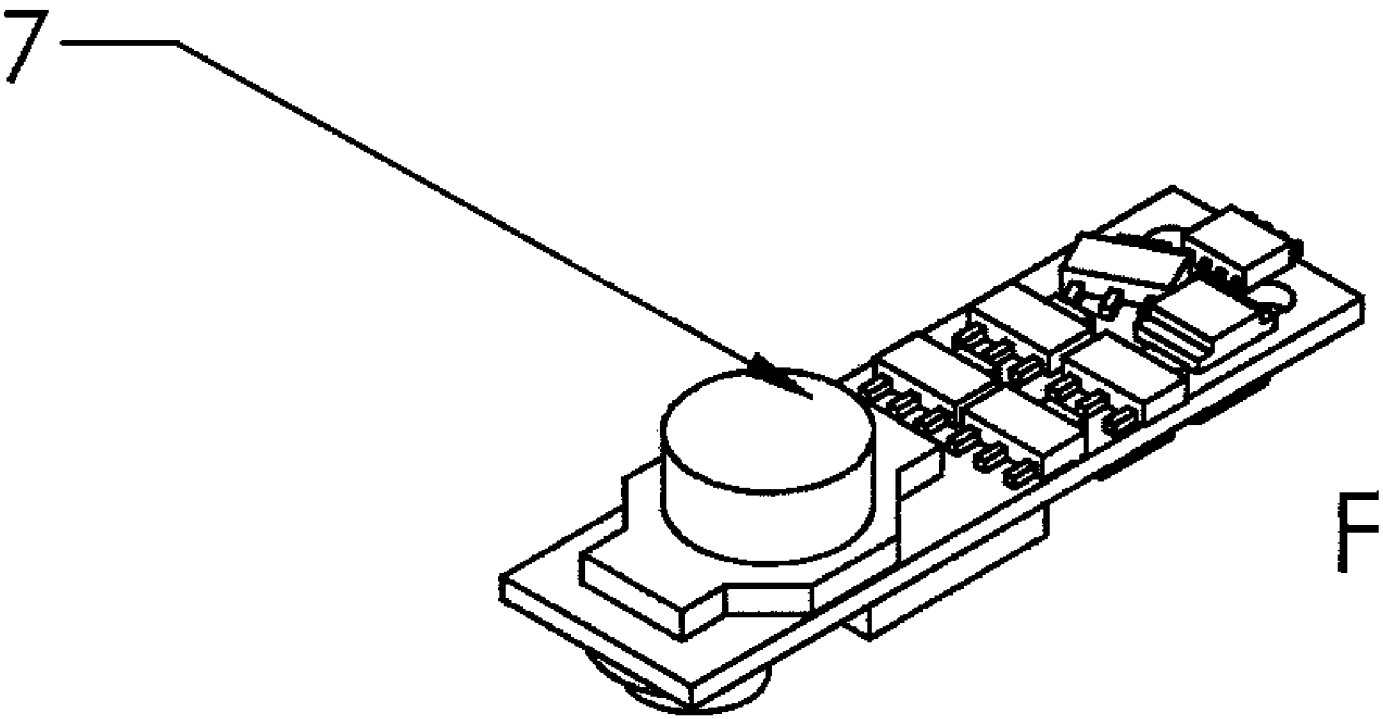
FIG. 8A is an isometric view of the circuit board.

FIG. 8 is a block diagram of the electronic circuitry 7. The output wires 4C from the generator 4 are connected to a rectifier 7A. The rectifier converts the ac output of the generator into dc and smoothes the dc. A filter 7B also serves to smooth and clean the dc. A regulator 7C supplies electrical power to the battery 3. When the drill stem is at rest, and then begins to rotate, there may be a tendency for the eccentric mass to rotate. To minimize this, the regulator connects the load (the power supply 3 or the sonde 2) to the generator only after the generator output voltage exceeds a predetermined voltage (for example 4.2V). This allows the generator to start up under a no-load condition. In addition, the regulator properly charges the power supply 3 and does not overcharge the power supply.

Figures 9A, 9B, 9C:
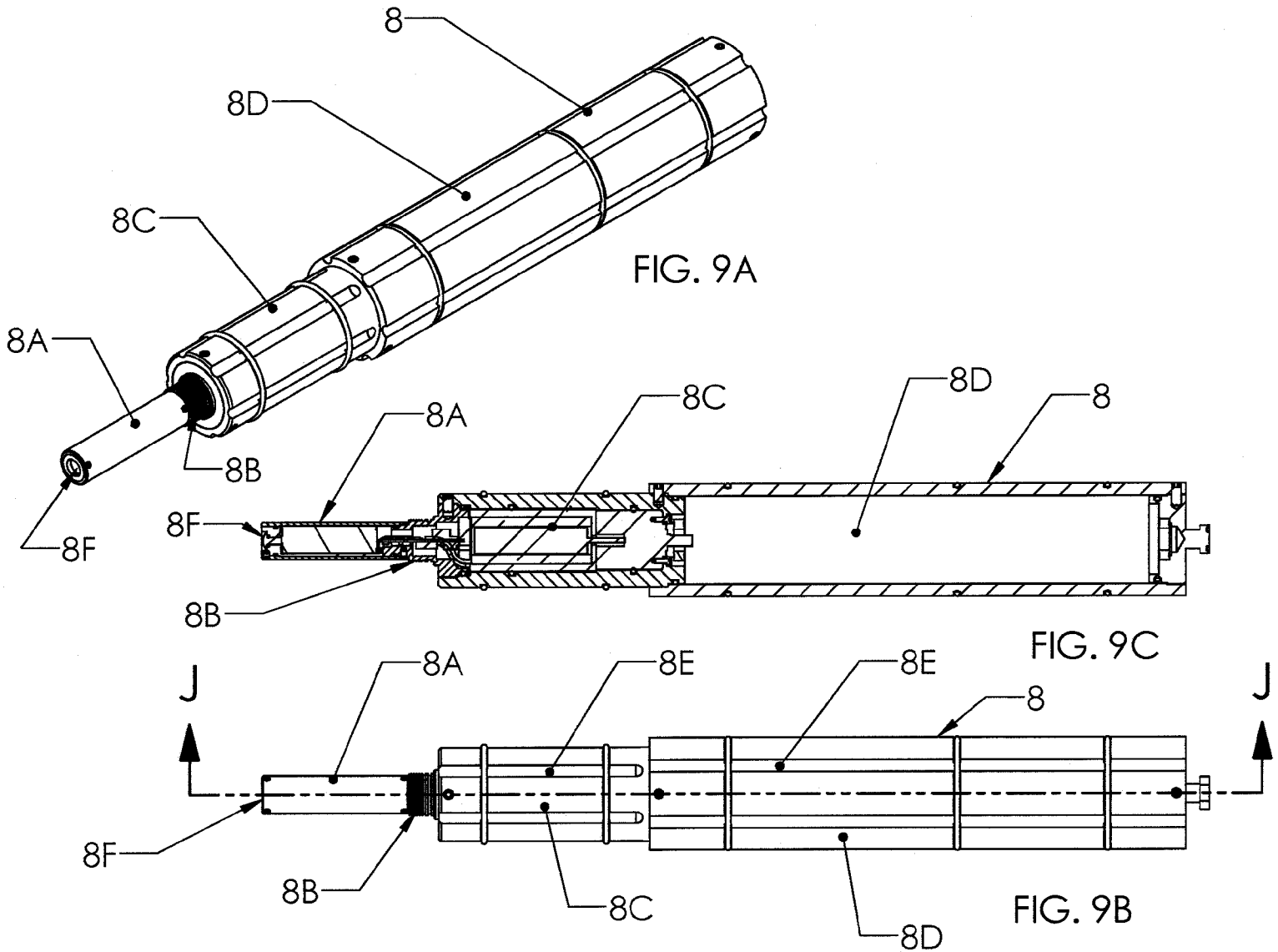
FIG. 9A is an isometric view of the case system.
FIG. 9B is a side view of the case system.
FIG. 9C is a cross sectional view taken along the lines J-J of the case system of FIG. 9B.

FIGS. 9A-9C shows the thermally conductive and corrosion resistant case system 8. The case system 8 is designed to house and protect all of the various components 3-7. The case system 8 has four sections. A rechargeable power source section 8A covers the rechargeable power source 3. The threaded circuit board section 8B covers the electronic circuitry 7, acts as a ground for the flow of power to the sonde 2, and is a waterproof coupling between the sonde 2 and the counterbalance enabled power generator 1. The external threads on section 8B provide the coupling. Case section 8C covers the generator 4 and the transmission 5. Mass section 8D covers and supports the eccentric mass 6. The sections 8C and 8D are designed to maximize their thermal transfer properties. This is done by using high thermally conductive material and maximizing their surface area by fluting 8E their exteriors. The end 8F acts as the positive terminal of the counterbalance enabled power generator 1.

Figure 10A:
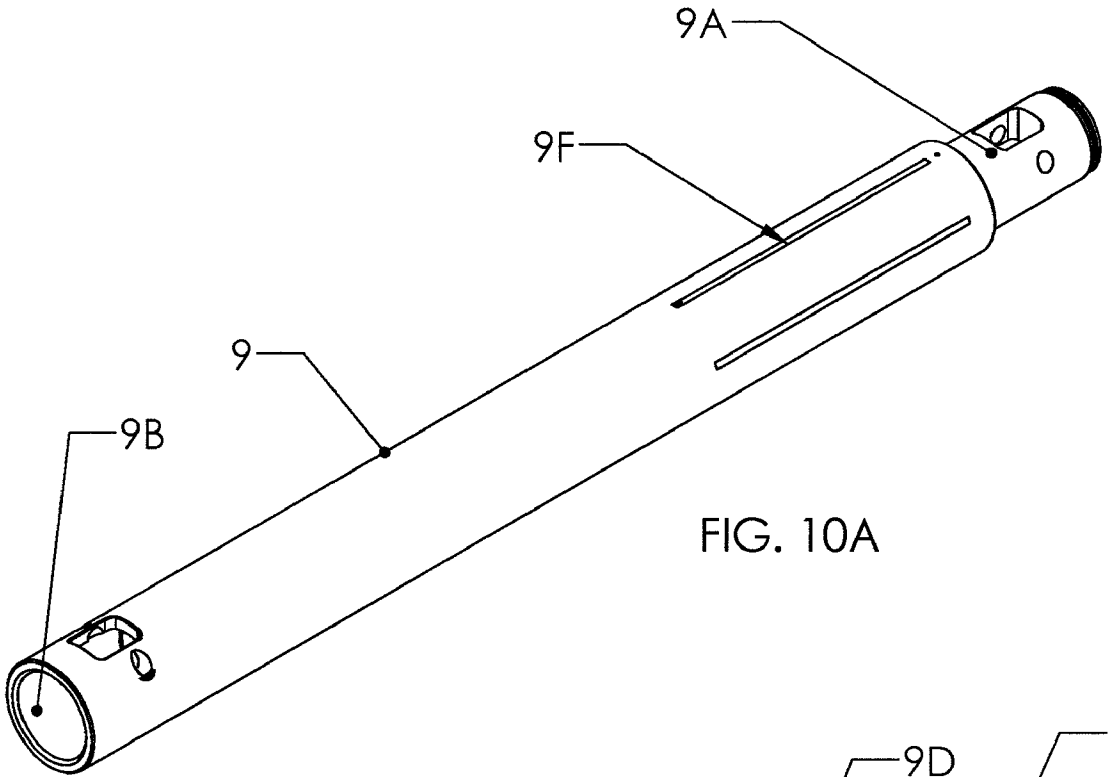
FIG. 10A is an isometric view of the sonde housing.
Figure 10B:
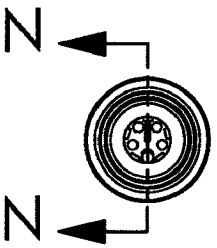
FIG. 10B is an end view of the sonde housing.
Figure 10C:
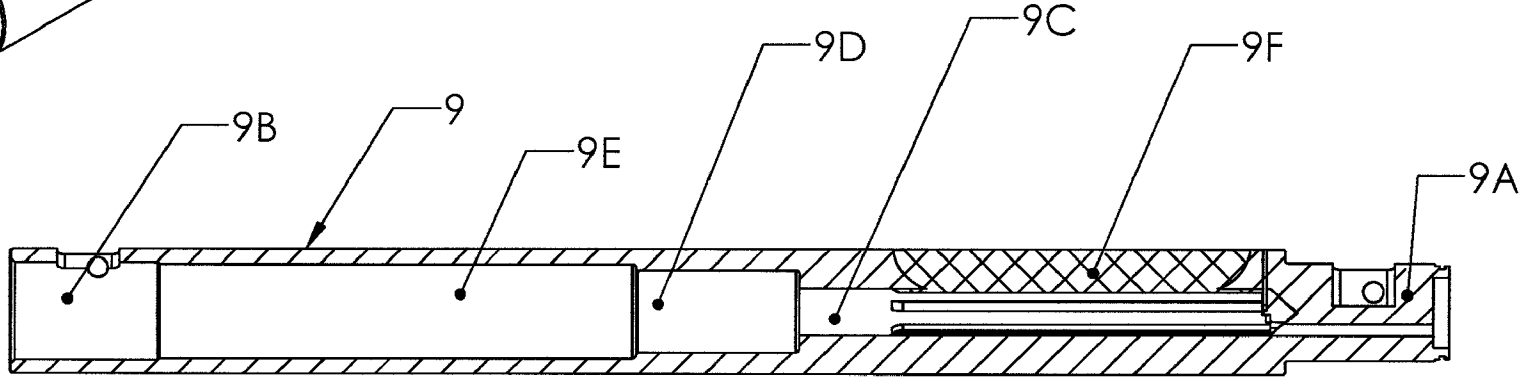
FIG. 10C is a cross-sectional view of the sonde housing taken along the line N-N of FIG. 10B.

FIGS. 10A-10C shows a sonde housing 9 is designed to house the counterbalance enabled power generator 1. The sonde housing 9 is designed to allow a cooling medium such as the drilling fluid used to drill the borehole to flow around and cool the case system 8 and the counterbalance enabled power generator 1 contained therein. The front end 9A of the sonde housing 9 attaches solidly to a drill bit (not shown). The rear end 9B of the sonde housing 9 attaches solidly to a drill string (not shown) and thus to a drill rig (not shown). Cavity 9C is designed to accept the sonde 2 and is somewhat larger in diameter than the sonde 2. Cavity 9D is designed to accept the circuit board section 8B and the generator section 8C of the case system 8. The cavity 9D is somewhat larger in diameter than the circuit board section 8B and generator section 8C of case system 8. Cavity 9E is designed to accept the mass section 8D. The cavity 9E is somewhat larger in diameter than the mass section 8D. The sonde housing 9 has numerous elongated slots 9F cut into its outer walls for the transmission of signals from the sonde 2 to the drill rig operator. The elongated slots 9F are filled with a substance that forms a water tight seal, acts as flexible support for the sonde 2 and also allows signals to exit from the interior of the sonde housing 9.

FIGS. 11A and 11B show a completed assembly of the counterbalance enabled power generator 1. The rechargeable power source 3, the electronic circuit 7, the generator 4, and the transmission 5 are attached to the case system 8 so as to rotate therewith. The eccentric mass 6 is not rotationally attached to the case system 8 and is free to remain stationary, due to the effects of gravity, as the case system 8 rotates with the drill stem.

Referring to FIGS. 7, 8, 11A and 11B, the positive terminal 3A of the rechargeable power source 3 is conductively attached to the positive terminal 8F of the case system 8 and to the positive output terminal of the electronic circuit 7. The negative terminal 3B of the rechargeable power source 3 is conductively attached to the negative terminal 8B of the case system 8 and to the negative output terminal on the electronic circuit 7. The electrically conductive leads 4C of the three phase AC generator 4 are conductively attached to the rectifiers 7E located in the electronic circuit 7. The rotor 4B of generator 4 is rotationally attached to the output component 5B of the transmission 5. The body 5C and the stator 4A are attached to the section 8C of the case system 8. The input component 5A of the transmission 5 is rotationally attached to the eccentric mass 6 such that the center of gravity 6A is not on the center line of the input component 5A of the transmission 5. The eccentric mass 6 is supported by bearings 10 located in the case system 8.

Figures 12A, 12B:
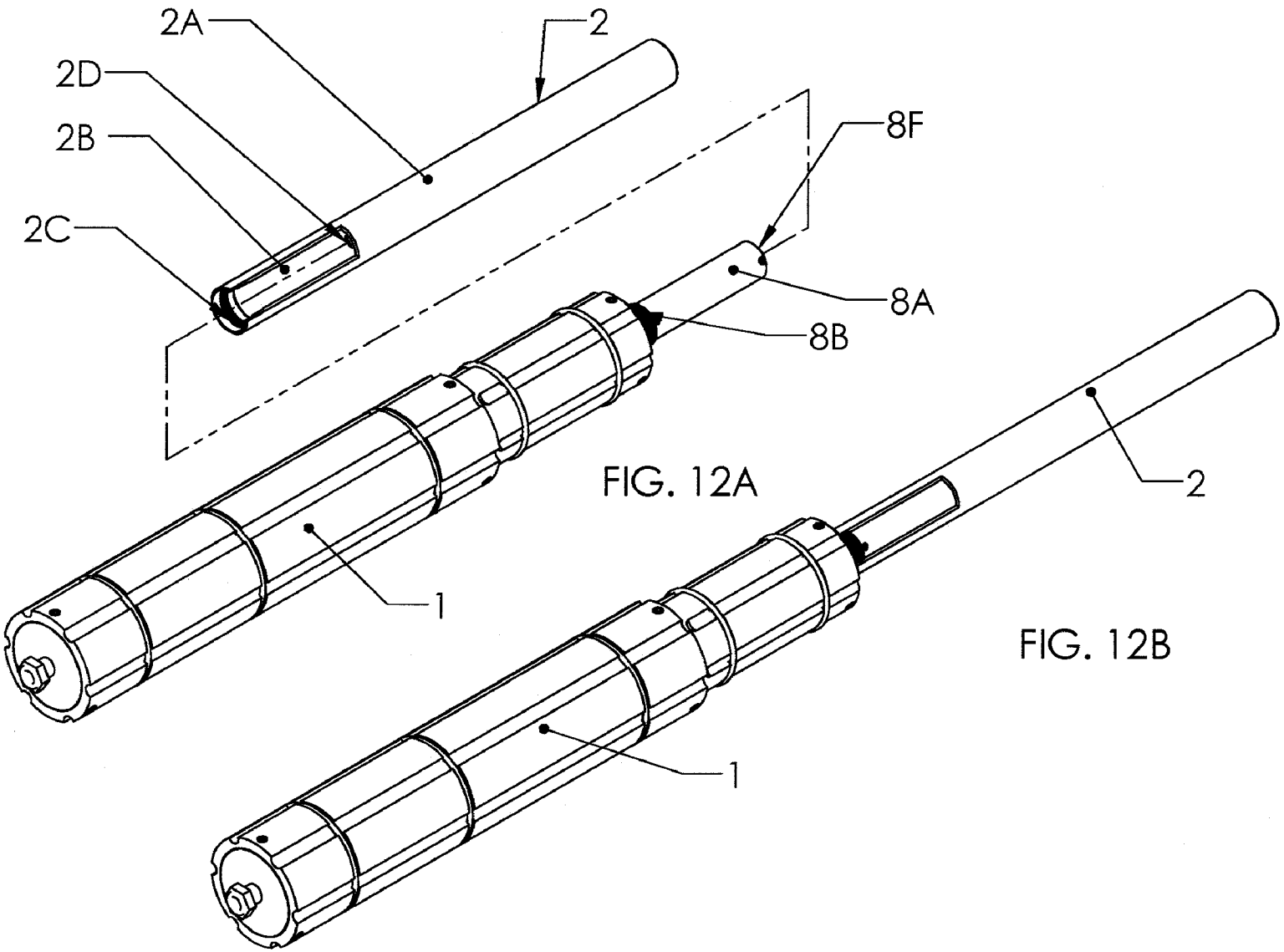
FIG. 12A is an exploded isometric view of the counterbalance enabled power generator.
FIG. 12B is an isometric view of the counterbalance enabled power generator.

FIGS. 12A and 12B show the counterbalance enabled power generator 1 attached to the sonde 2 (the sonde is shown partially cut-away to reveal the rechargeable power source section 8A). This configuration allows the counterbalance enabled power generator 1 to power the sonde 2. The rechargeable power source section 8A of the case system 8 of the counterbalance enabled power generator 1 is inserted into the cavity 2B of the sonde 2, causing the positive terminal 8F to contact the positive terminal 2D and the threads 2C are then mated to the threads 8B making the negative ground.

Figures 13A, 13B, 13C:
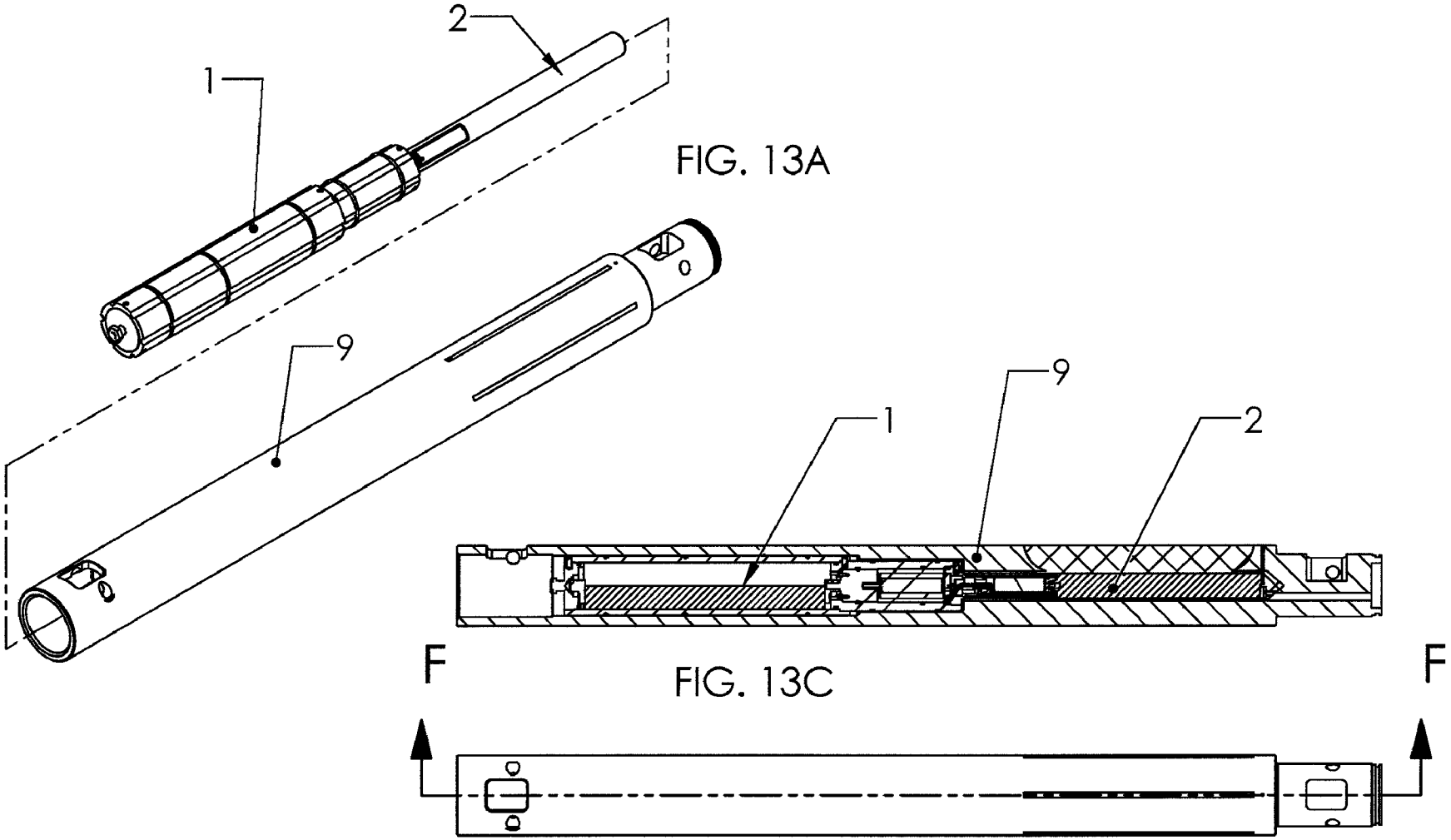
FIG. 13A is an exploded isometric view of the counterbalance enabled power generator and the sonde housing.
FIG. 13B is a side view of the counterbalance enabled power generator and the sonde housing.
FIG. 13C is a cross sectional view of the counterbalance enabled power generator and the sonde housing taken along the line F-F.

FIGS. 13A-13C shows the counterbalance enabled power generator 1 attached to the sonde 2 solidly installed in the sonde housing 9.

Operation

Once the sonde housing 9 is fitted onto the drill string and an appropriate drill bit is fitted onto the opposite end of the sonde housing 9, drilling can commence. During drilling, the drill string rotates and is thrust into the ground. As the drill string rotates, the sonde housing 9 rotates, as does the sonde 2 and most of the components of the counterbalanced enabled power generator 1. In particular, the following components rotate: the rechargeable power source 3, the electronic circuit 7, the stator 4A and the body 5C of the transmission 5. The case system 8 rotates in conjunction with the sonde housing 9 and the drill stem. A pin (not shown) extends from the sonde housing 9 into a receptacle in the sonde 2. The pin both orients the sonde 2 and prevents it from rotating. In addition, o-rings are provided around the case system 8 to create friction and prevent rotation as well as providing cushioning. In addition, pins can be provided elsewhere to prevent rotation.

The transmission input shaft 5A is held relatively rotationally stationary by the eccentric mass 6. The eccentric mass 6 is supported on bearings which allow it to not rotate when the case system 8 and the other attached components rotate. The eccentric mass 6 is held relatively rotationally stationary inside of the case system 8 due to gravity. The drill stem and consequently the case system 8 are more horizontal than vertical. Thus, the drill stem rotates about the eccentric mass 6. As the body 5C of the transmission 5 rotates and the input shaft 5A is held rotationally stationary, the output component 5B rotates in the opposite direction, or counter-rotates, relative to the body 5C. The rotor 4B, which is coupled to the output component 5B likewise counter-rotates with respect to the stator 4A. Thus, there is relative rotation between the rotor 4B and the stator 4A, and electrical power is produced. The electrical power is transferred via the electrically conductive media 4C to the electrical circuit 7.

In the preferred embodiment, the drill string rotates at 85-300 rpm, with about 150 rpm being typical. The generator 4 requires a relative speed ratio between the rotor 4B and the stator 4C of about 1000:1 to produce an adequate supply of power. Some generators may work satisfactorily without the rotor counter-rotating relative to the stator. Also some generators may have the rotor held stationary directly via the counterbalance foregoing the transmission. This still produces relative rotation between the rotor and stator.

Referring to FIG. 7 the electrical power produced by the generator 4 is restricted and regulated by the electric circuit 7 and is used to charge the power supply 3 and power the sonde 2.

Thus, the sonde can operate for extended periods of time, without the need to replace the power supply. The drill stem need not be pulled from the hole to replace batteries, as required in the prior art. Furthermore, the sonde can transmit a stronger signal. Such signal transmission requires more electrical power, and in the prior art required either expensive specialized batteries, or frequent battery changes.

In the preferred embodiment, the generator 4 produces a more power than what the sonde 2 requires. For example, the sonde 2 may draw 300 mA, while the generator 4 produces 600 mA. The drill string does not always rotate; therefore, the generator 4 has the power to operate the sonde 2 and charge the rechargeable power source 3 while the stem is rotating. Alternatively the generator 4 recharges the rechargeable power source 3 faster than it is drained by the sonde 2.

During drilling operations, water circulates around the case system 8. In particular, the water flows in the flutes 8E, beneath the o-rings. The water serves to cool the counterbalance enabled power generator 1. The water also flows to the drill bit for assisting in the cutting by carrying away tailings and cooling the drill bit.

During the commencement of drilling operations, the electronic circuit 7 regulates the load on the generator 4 in order to maintain the eccentric mass 6 in a relatively rotationally stationary position. This is known as a soft start up. As the drill string begins to rotate, there may be a tendency for the eccentric mass 6 to rotate as well, due to friction in the bearings 10. The friction in the bearings 10 is quickly overcome by continued rotation of the drill string. The load on the generator 4 is non-existent because of the electronic circuit 7, which does not draw a load until the generator produces more voltage than the rechargeable power source requires. Because the load on the generator is non-existent during the commencement of drilling, there is little "drag" on the rotor 4A and the eccentric mass 6, wherein the eccentric mass 6 can remain relatively rotationally stationary.

The foregoing disclosure and showings made in the drawings are merely illustrative of the principles of this invention and are not to be interpreted in a limiting sense.

The invention claimed is:

1. An electrical generating system for use in a horizontal directional drilling system, the drilling system having a generally horizontal drill stem that rotates, comprising:

a) a generator having a first component coupled to rotate with the drill stem, and a second component capable of relative rotation with respect to the first component, one of the first and second components comprising an armature and the other of the first and second components comprising a field;

b) an eccentric mass mounted inside of the drill stem and rotatably mounted with respect to the drill stem so that as the drill stem rotates, the eccentric mass can remain stationary;

c) the eccentric mass coupled to the second component, wherein when the drill stem rotates, relative rotational motion is produced between the first and second components and the generator produces electrical power.

2. The electrical generating system of claim 1, further comprising a transmission, with an input and an output, the eccentric mass coupled to the transmission input and the second component coupled to the transmission output.

3. The electrical generating system of claim 2, wherein the second component counter-rotates relative to the first component.

4. The electrical generating system of claim 1, further comprising a sonde electrically connected to the generator.

5. The electrical generating system of claim 1, wherein the second component comprises a rotor.

6. The electrical generating system of claim 1, wherein the eccentric mass further comprises two spaced apart mounting points where the mass is rotatably mounted to the drill stem.

7. The electrical generating system of claim 1, further comprising flow channels for drilling fluid flowing through the drill stem.

8. The electrical generating system of claim 1, wherein:

a) the second component comprises a rotor;

b) the eccentric mass further comprises two spaced apart mounting points where the mass is rotatably mounted to the drill stem.

9. The electrical generating system of claim 1, further comprising:

a) a transmission, with an input and an output, the eccentric mass coupled to the second component through the transmission with the eccentric mass coupled to the transmission input and the second component coupled to the transmission output;

b) a sonde electrically connected to the generator;

c) the second component comprises a rotor;

d) the eccentric mass further comprises two spaced apart mounting points where the mass is rotatably mounted to the drill stem.

10. The electrical generating system of claim 1, wherein the eccentric mass is held relatively stationary by gravity as the drill stem rotates.

11. The electrical generating system of claim 1, further comprising an electrical regulator electrically connected to an output of the generator.

12. The electrical generating system of claim 11, wherein the electrical regulator is electrically connected to a load, the regulator connecting the load to the generator output when the generator provides a voltage that exceeds a predetermined threshold.

* * * * *